US009023575B2

(12) United States Patent
Katsura et al.

(10) Patent No.: US 9,023,575 B2
(45) Date of Patent: May 5, 2015

(54) TONER AND METHOD FOR PRODUCING TONER

(71) Applicant: Canon Kabushiki Kaisha, Tokyo (JP)

(72) Inventors: Taiji Katsura, Suntou-gun (JP); Naotaka Ikeda, Suntou-gun (JP); Emi Watanabe, Suntou-gun (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/023,272

(22) Filed: Sep. 10, 2013

(65) Prior Publication Data

US 2014/0080048 A1 Mar. 20, 2014

(30) Foreign Application Priority Data

Sep. 14, 2012 (JP) ..... 2012-202399

(51) Int. Cl.
*G03G 9/087* (2006.01)
*G03G 9/08* (2006.01)

(52) U.S. Cl.
CPC ..... *G03G 9/0804* (2013.01); *G03G 9/08* (2013.01); *G03G 9/0806* (2013.01)

(58) Field of Classification Search
USPC ..... 430/137.15
See application file for complete search history.

(56) References Cited

U.S. PATENT DOCUMENTS

| | | | | |
|---|---|---|---|---|
| 4,839,255 | A * | 6/1989 | Hyosu et al. | 430/137.18 |
| 5,219,697 | A * | 6/1993 | Mori et al. | 430/110.3 |
| 6,120,963 | A * | 9/2000 | Park et al. | 430/109.3 |
| 2006/0099530 | A1 * | 5/2006 | Lee et al. | 430/137.15 |

FOREIGN PATENT DOCUMENTS

| | | | |
|---|---|---|---|
| JP | 2006-220673 | A | 8/2006 |
| JP | 2007-171666 | A | 7/2007 |

* cited by examiner

*Primary Examiner* — Hoa V Le
(74) *Attorney, Agent, or Firm* — Canon U.S.A. Inc., IP Division

(57) ABSTRACT

A toner is provided that can maintain high transferability even in long-term image output, can maintain high chargeability even in a high temperature and high humidity environment, and rarely causes fogging due to charging failure. The toner contains toner particles produced by a suspension polymerization method or a dissolution suspension method. The volume-average particle diameter (Dv) of silica particles is 50 nm or more and 800 nm or less. The mass loss rate due to heating of the silica particles from 105° C. to 200° C. is 0.60% or less. The hydrophobicity of the silica particles is 5% or more and less than 40%.

6 Claims, No Drawings

TONER AND METHOD FOR PRODUCING TONER

BACKGROUND OF THE INVENTION

1. Field of the Invention

The present invention relates to an electrostatic image developing toner for use in electrophotographic image formation.

2. Description of the Related Art

User requirements concerning electrophotographic apparatuses (electrophotographic image-forming apparatuses), such as copying machines and printers, are becoming increasingly complex year by year. There is a recent demand for high durability to withstand high-speed printing and consistent image quality independent of the operating environment (temperature and humidity).

It is known that image quality can be improved by the addition of a submicron external additive to toner base particles. Japanese Patent Laid-Open No. 2007-171666 discloses a technique of adding submicron silica particles to toner base particles to decrease the physical adhesion strength between toner and a transfer member, thereby improving toner transferability and image quality.

However, submicron silica particles tend to separate from toner particles because of stress in a developing apparatus. The separation of silica particles from toner particles often results in low toner transferability. Silica particles separated from toner particles may cause soiling of a member, such as a charge member, during printing of many copies. Soiling of such a member tends to reduce image quality and makes it difficult to maintain high image quality in long-term image output.

It is known that such a problem can be solved by the internal addition of silica particles to toner base particles. Japanese Patent Laid-Open No. 2006-220673 discloses a technique of internally adding silica particles to toner base particles to fix the silica particles on a surface layer of each of the toner base particles in the production of toner particles in an aqueous medium, thereby preventing the silica particles from separating from the toner base particles.

In the production of toner particles in an aqueous medium, however, in order to internally add silica particles to toner base particles and place the silica particles on the outermost surface layer of each of the toner base particles, it is necessary to reduce the degree to which the silica particles are subjected to hydrophobic treatment so as to increase the hydrophilicity of the silica particles.

Reduction of the degree to which the silica particles are subjected to hydrophobic treatment, however, tends to increase the hygroscopicity of the silica particles. This often lowers toner chargeability in a high temperature and high humidity environment, possibly causing fogging due to charging failure.

Thus, a method of internally adding silica particles to toner base particles to fix the silica particles on a surface layer of each of the toner base particles, thereby preventing the silica particles from separating from the toner base particles is effective in the production of toner particles in an aqueous medium.

However, there is still room for improvement in order to maintain high toner transferability and suppress poor image quality, such as fogging, even in long-term image output while the decrease in toner chargeability is suppressed even in a high temperature and high humidity environment.

SUMMARY OF THE INVENTION

The present invention provides a toner that can maintain high transferability even in long-term image output, can maintain high chargeability even in a high temperature and high humidity environment, and rarely causes fogging due to charging failure.

As a result of extensive studies on a toner produced by the internal addition of silica particles to toner base particles, the present inventors found that the following toner and method for producing the toner can solve the problems described above.

The present invention provides a toner containing toner particles produced by a method including the following (i) or (ii):

(i) adding a polymerizable monomer composition containing a polymerizable monomer and silica particles to an aqueous medium to form particles of the polymerizable monomer composition and polymerizing the polymerizable monomer contained in the particles to produce toner particles; or (ii) mixing a binder resin, the silica particles, and an organic solvent that can dissolve the binder resin to prepare a resin solution containing dispersed silica particles and the binder resin dissolved in the organic solvent, adding the resin solution to an aqueous medium to form particles of the resin solution, and removing the organic solvent from the particles to produce toner particles, wherein the silica particles have a volume-average particle diameter (Dv) of 50 nm or more and 800 nm or less, the mass loss rate due to heating of the silica particles from 105° C. to 200° C. is 0.60% or less, and the hydrophobicity of the silica particles is 5% or more and less than 40%.

The present invention provides a method for producing a toner, comprising the following (i) or (ii):

(i) adding a polymerizable monomer composition containing a polymerizable monomer and silica particles to an aqueous medium to form particles of the polymerizable monomer composition and polymerizing the polymerizable monomer contained in the particles to produce toner particles; or (ii) mixing a binder resin, the silica particles, and an organic solvent that can dissolve the binder resin to prepare a resin solution containing dispersed silica particles and the binder resin dissolved in the organic solvent, adding the resin solution to an aqueous medium to form particles of the resin solution, and removing the organic solvent from the particles to produce toner particles, wherein the silica particles have a volume-average particle diameter (Dv) of 50 nm or more and 800 nm or less, the mass loss rate due to heating of the silica particles from 105° C. to 200° C. is 0.60% or less, and the hydrophobicity of the silica particles is 5% or more and less than 40%.

The present invention provides a toner that can maintain high transferability even in long-term image output, can maintain high chargeability even in a high temperature and high humidity environment, and rarely causes fogging due to charging failure.

Further features of the present invention will become apparent from the following description of exemplary embodiments.

DESCRIPTION OF THE EMBODIMENTS

A toner according to an embodiment of the present invention contains a binder resin and silica particles. The toner contains toner particles produced by a method including the following (i) or (ii):

(i) adding a polymerizable monomer composition containing a polymerizable monomer and silica particles to an aqueous medium to form particles of (granulate) the polymerizable monomer composition and polymerizing the polymerizable monomer contained in the particles to produce toner particles; or (ii) mixing a binder resin, the silica particles, and an organic solvent that can dissolve the binder resin to prepare a resin solution containing dispersed silica particles and the binder resin dissolved in the organic solvent, adding the resin solution to an aqueous medium to form particles of (granulate) the resin solution, and removing the organic solvent from the particles to produce toner particles.

In toner particles produced by the method including (i), the binder resin is synthesized by the polymerization of the polymerizable monomer.

In the toner, the silica particles have a volume-average particle diameter (Dv) of 50 nm or more and 800 nm or less, the mass loss rate due to heating of the silica particles from 105° C. to 200° C. is 0.60% or less, and the hydrophobicity of the silica particles is 5% or more and less than 40%.

The silica particles will be described below.

Among silica particles for use in toners, the particular silica particles internally added to toner base particles are also referred to as "silica particles-A".

As described above, the silica particles-A have a volume-average particle diameter (Dv) of 50 nm or more and 800 nm or less and have a relatively large particle size. Silica particles having a volume-average particle diameter (Dv) of less than 50 nm cannot have a sufficient spacer effect. Thus, use of silica particles having a volume-average particle diameter (Dv) of less than 50 nm often results in low toner transferability. Furthermore, use of silica particles having a volume-average particle diameter (Dv) of less than 50 nm tends to result in degradation of the toner particle surface. On the other hand, use of silica particles having a volume-average particle diameter (Dv) of more than 800 nm instead of the silica particles-A often results in the separation of the silica particles from toner particles. During long-term image output, therefore, toner chargeability often decreases, and fogging due to charging failure occurs frequently. Furthermore, large silica particles separated from toner particles often adhere to various members (such as a charge member) in an electrophotographic apparatus, thus causing soiling. Soiling of a charge member may result in a deterioration in the charging characteristics of the charge member and fogging associated with the deterioration. The volume-average particle diameter (Dv) of silica particles is preferably 80 nm or more and 780 nm or less, more preferably 200 nm or less.

The coefficient of variation of volume particle size distribution of the silica particles-A may be 23% or less. The coefficient of variation of volume particle size distribution is measured as described below. A smaller coefficient of variation of volume particle size distribution indicates a narrower particle size distribution of silica particles (more uniform silica particle size). When the coefficient of variation of volume particle size distribution of the silica particles-A is 23% or less, the silica particles-A have a more effective spacer effect on the toner base particle surface. This further improves toner transferability. In addition, even in long-term image output, the toner has high chargeability and flowability. Furthermore, the toner particles have more uniform chargeability and improved transferability. The coefficient of variation of volume particle size distribution of the silica particles-A is preferably 15% or less, more preferably 10% or less.

The mass loss rate due to heating of the silica particles-A from 105° C. to 200° C. (hereinafter also referred to simply as "mass loss rate") is 0.60% or less. The mass loss rate refers to the mass loss percentage of silica particles measured from 105° C. to 200° C. with a thermogravimetric analyzer (TGA) when the silica particles are heated from 50° C. to 500° C. at normal pressure (1 atm). While silica particles are heated, silanol groups of the silica particles are dehydrated and condensed at approximately 130° C. Thus, the mass of the silica particles decreases. Water and other volatile substances adhering to silica particles except for silanol groups substantially completely volatilize at approximately 105° C. at normal pressure (1 atm). HMDS and silicone oil generally used as surface-treating agents for silica particles do not volatilize at approximately 200° C. at normal pressure (1 atm) and begin to volatilize at more than 200° C. (approximately 250° C.)

Thus, the present inventors think that the mass loss rate of silica particles from 105° C. to 200° C. can be measured to determine the number of silanol groups of the silica particles.

Since the silanol groups of silica particles are water adsorption sites, the hygroscopicity of the silica particles greatly depends on the number of silanol groups of the silica particles. The number of silanol groups of silica particles has a great influence on toner chargeability, flowability, and transferability. Use of silica particles having a mass loss rate of more than 0.60% instead of the silica particles-A results in a large amount of water adsorbed on the silica particles particularly in a high humidity environment, because of a large number of silanol groups of the silica particles, often resulting in low toner chargeability and flowability. Low flowability often results in low toner transferability. The mass loss rate of silica particles is preferably 0.10% or less, more preferably 0.02% or less.

As described above, the hydrophobicity of the silica particles-A is 5% or more and less than 40%. In a process of producing toner particles of a toner according to an embodiment of the present invention, the hydrophobicity of silica particles is an important physical property that defines the state of the silica particles in the toner particles. When silica particles in the polymerizable monomer composition or the resin solution (hereinafter also collectively referred to as a "toner composition") have low hydrophobicity, the silica particles in the toner composition placed in an aqueous medium are likely to move into the aqueous medium. On the other hand, when silica particles have high hydrophobicity, the silica particles in the toner composition rarely move into the aqueous medium. The hydrophobicity of silica particles in a toner composition can be controlled to place the silica particles in the vicinity of an interface between an aqueous medium and toner composition particles formed in the aqueous medium. Thus, use of silica particles having a hydrophobicity of less than 5% instead of the silica particles-A results in an increase in the number of silica particles that move from the toner composition particles to the aqueous medium, making it difficult to efficiently internally add the silica particles to the toner base particles. Use of silica particles having a hydrophobicity of 40% or more instead of the silica particles-A makes it difficult to place a proper number of silica particles in the vicinity of the surface of each toner base particle. Use of the silica particles-A having a hydrophobicity of 5% or more and less than 40% allows a proper number of silica particles-A to be placed in the vicinity of the surface of each toner base particle (a proper number of silica particles-A to be placed on the outermost surface of each toner base particle). Thus, the silica particles-A have a good spacer effect. The silica particles-A preferably have a hydrophobicity of 6% or more, more preferably 10% or more, and preferably 36% or less, more preferably 35% or less.

Silica particles may be subjected to hydrophobic treatment by various methods. For example, silica particles may be subjected to hydrophobic treatment by treating the silica particles with a hydrophobic treatment agent in a dry process or in a wet process.

The dry hydrophobic treatment method can reduce the aggregation of silica particles and impart excellent flowability to the toner. The dry hydrophobic treatment method may include spraying a hydrophobic treatment agent on stirred silica particles or introducing a vaporized hydrophobic treatment agent into silica particles on a fluidized bed or stirred silica particles.

Examples of the hydrophobic treatment agent for silica particles include chlorosilanes, such as methyltrichlorosilane, dimethyldichlorosilane, trimethylchlorosilane, phenyltrichlorosilane, diphenyldichlorosilane, t-butyldimethylchlorosilane, and vinyltrichlorosilane, alkoxysilanes, such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, and γ-(2-aminoethyl)aminopropylmethyldimethoxysilane, silazanes, such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane, silicone oils, such as dimethyl silicone oil, methyl hydrogen silicone oil, methylphenyl silicone oil, alkyl-modified silicone oils, chloroalkyl-modified silicone oils, chlorophenyl-modified silicone oil, fatty acid-modified silicone oils, polyether-modified silicone oils, alkoxy-modified silicone oils, carbinol-modified silicone oils, amino-modified silicone oils, fluorine-modified silicone oils, and terminal reactive silicone oils, siloxanes, such as hexamethylcyclotrisiloxane, octamethylcyclotetrasiloxane, decamethylcyclopentasiloxane, hexamethyldisiloxane, and octamethyltrisiloxane, long-chain fatty acids, such as undecyl acid, lauric acid, tridecyl acid, dodecyl acid, myristic acid, palmitic acid, pentadecylic acid, stearic acid, heptadecyl acid, arachidic acid, montanic acid, oleic acid, linoleic acid, and arachidonic acid, and salts of the fatty acids and metals, such as zinc, iron, magnesium, aluminum, calcium, sodium, and lithium. Among these hydrophobic treatment agents, alkoxysilanes, silazanes, and silicone oils (particularly straight silicone oils) facilitate hydrophobic treatment of silica particles. These hydrophobic treatment agents may be used alone or in combination. When two or more hydrophobic treatment agents are used, a mixture of two or more hydrophobic treatment agents may be used in surface treatment of silica particles, or two or more hydrophobic treatment agents may be sequentially used in surface treatment of silica particles.

Many hydrophobic treatment agents for silica particles contain carbon, as described above. In the silica particles-A subjected to hydrophobic treatment with a hydrophobic treatment agent containing carbon, the carbon content derived from the hydrophobic treatment agent is preferably 1.0% by mass or less. The carbon content derived from a hydrophobic treatment agent in silica particles is an indicator of the amount of hydrophobic treatment agent used. When the carbon content of the silica particles-A derived from a hydrophobic treatment agent is 1.0% by mass or less, this indicates a proper amount of hydrophobic treatment agent used, and a proper number of silica particles-A can be placed in the vicinity of the surface of each toner base particle. The carbon content derived from a hydrophobic treatment agent is more preferably 0.8% by mass or less.

The immobilization rate of a hydrophobic treatment agent in the silica particles-A is preferably 90% or more. When the immobilization rate of a hydrophobic treatment agent in the silica particles is 90% or more, the hydrophobic treatment agent is rarely isolated in a process of producing toner particles contained in a toner according to an embodiment of the present invention. This can stabilize the hydrophobicity of the silica particles and allows the silica particles to be stably placed in the vicinity of the surface of each toner base particle. The immobilization rate of a hydrophobic treatment agent in the silica particles is more preferably 91% or more. The maximum immobilization rate of a hydrophobic treatment agent in the silica particles is theoretically 100%.

<Measurement of Volume-Average Particle Diameter (Dv) and Coefficient of Variation of Volume Particle Size Distribution of Silica Particles>

The volume-average particle diameter (Dv) and the coefficient of variation of volume particle size distribution of silica particles were measured with a measuring apparatus available from Sysmex Corp. (trade name: Zetasizer Nano-ZS). More specifically, the volume-average particle diameter (Dv) and the coefficient of variation of volume particle size distribution of silica particles are determined as described below.

First, the volume particle size distribution of silica particles is measured with the measuring apparatus to determine the standard deviation of the volume particle size distribution ("width" in the measuring apparatus) and the volume-average particle diameter (Dv). The coefficient of variation of volume particle size distribution can be calculated using the following equation. As indicated by the equation, the coefficient of variation of volume particle size distribution is the ratio (%) of the standard deviation of the volume particle size distribution to the volume-average particle diameter.

Coefficient of variation of volume particle size distribution (%)=(Standard deviation of volume particle size distribution/Volume-average particle diameter (Dv))×100

The sample preparation and the measurement conditions are described below.

1 mg of silica particles were added to 20 mL of methanol and were dispersed for 3 minutes with a homogenizer manufactured by SMT Co., Ltd. In order to reduce the aggregation of the silica particles, the volume-average particle diameter (Dv) and the coefficient of variation were measured under the following conditions immediately after the dispersion.

[Measurement Conditions]

Cell: DTS0012-Disposable sizing cuvette
Dispersant: Methanol
Refractive Index:
material:1.460
dispersant: 1.329
Temperature: 25° C.
Measurement duration:
Number of runs: 5
Runs duration (Seconds): 10
Result Calculation: General Purpose <Method for Measuring Mass Loss Rate of Silica Particles>

The mass loss rate of silica particles was measured as described below with a measuring apparatus manufactured by TA Instrument (trade name: Hi-Res TGA 2950 thermogravimetric analyzer).

0.03 g of a sample silica particles in a pan for the measuring apparatus was placed in the measuring apparatus. The sample weight was determined in consideration of the bulkiness of the silica particles. The sample was held in an equilibrium state at normal pressure (1 atm) at 50° C. for 10 minutes before the mass ($M_{50}$) of the silica particles was measured. After that, nitrogen gas was supplied to the measuring apparatus. While the sample was heated to 500° C. at 20° C./min at normal pressure (1 atm), the mass change was measured. The mass loss rate was the percentage of the mass loss of silica particles (ΔM) from 105° C. to 200° C. relative to the mass ($M_{50}$) of silica particles measured after holding at 50° C. for 10 minutes.

$$\text{Mass loss rate (\%)}=(\Delta M/M_{50})\times 100$$

<Method for Measuring Hydrophobicity of Silica Particles>

The hydrophobicity of silica particles was measured as described below.

A fluoropolymer-coated spindle rotor having a length of 25 mm and a maximum body diameter of 8 mm was placed in a cylindrical glass vessel having a diameter of 5 cm and a thickness of 1.75 mm. The cylindrical glass vessel was charged with 50 mL of ion-exchanged water and then with 0.2 g of silica particles and was placed in a powder wettability tester manufactured by Rhesca Corp. (trade name: WET-100P). Methanol was added to the water at 0.8 mL/min in the powder wettability tester while stirring with a magnetic stirrer at 200 rpm. No silica particles was observed on the liquid surface at the endpoint. The hydrophobicity of the silica particles was expressed by the methanol volume percentage of the mixture of methanol and water (=(volume of methanol/volume of mixture)×100) at the endpoint.

<Method for Measuring Carbon Content of Silica Particles>

The carbon content of silica particles derived from a hydrophobic treatment agent was measured with a carbon-sulfur analyzer manufactured by Horiba, Ltd. (trade name: EMIA-320). 0.3 g of a sample silica particles was weighed in a crucible for the carbon-sulfur analyzer. 0.3±0.05 g of tin (option No. 9052012500) and 1.5±0.1 g of tungsten (option No. 9051104100) were added as combustion accelerators. The silica particles were heated at 1100° C. in an oxygen atmosphere in accordance with an instruction manual of the carbon-sulfur analyzer. The hydrophobic groups on the surface of the silica particles derived from the hydrophobic treatment agent were thermally decomposed into $CO_2$, and the amount of $CO_2$ was measured. The carbon content (% by mass) of the silica particles was determined from the amount of $CO_2$ and was considered to be the carbon content derived from a hydrophobic treatment agent (hereinafter also referred to simply as "carbon content").

<Method for Measuring Immobilization Rate of Hydrophobic Treatment Agent in Silica Particles>

The immobilization rate of a hydrophobic treatment agent in silica particles was measured by the following method.

An Erlenmeyer flask was charged with 0.50 g of silica particles and 40 mL of chloroform and was sealed with a stopper. The silica particles and chloroform were stirred for two hours. After the stirring was stopped, the Erlenmeyer flask was left still for 12 hours. The supernatant liquid was completely removed by centrifugation. The centrifugation was performed with a centrifuge manufactured by Kokusan Co., Ltd. (trade name: H-9R), a Bn1 rotor, and a polymer centrifuge tube for the Bn1 rotor at 20° C. at 10000 rpm for 5 minutes.

The centrifuged silica particles were again put into an Erlenmeyer flask. 40 mL of chloroform was added to the centrifuged silica particles. The Erlenmeyer flask was sealed with a stopper. The silica particles and chloroform were stirred for two hours. After the stirring was stopped, the Erlenmeyer flask was left still for 12 hours. The supernatant liquid was completely removed by centrifugation. This procedure was performed twice. The resulting sample was dried in a thermostat at 50° C. for two hours. The sample was further dried at 0.07 MPa at 50° C. for 24 hours to completely volatilize chloroform.

The carbon content of silica particles thus treated with chloroform and the carbon content of silica particles before the chloroform treatment were measured in the same manner as in the "Method for Measuring Carbon Content of Silica Particles". The immobilization rate of the hydrophobic treatment agent in the silica particles can be calculated using the following equation.

Immobilization rate of hydrophobic treatment agent in silica particles (%)=(Carbon content of silica particles treated with chloroform/Carbon content of silica particles)×100

A method for producing silica particles-A will be described below.

The silica particles-A may be produced by the following method.

- A firing method for firing a silane compound to produce silica particles (that is, a method for producing fumed silica).
- A deflagration method for deflagrating a metallic silicon powder to produce silica particles.
- A wet process for producing silica particles through a neutralization reaction between sodium silicate and mineral acid (a synthesis under alkaline conditions is referred to as a precipitation method, and a synthesis under acidic conditions is referred to as a gel method).
- A sol-gel method for producing silica particles by hydrolysis of an alkoxysilane, such as hydrocarbyloxysilane (Stoeber process)

Among these, the sol-gel method can produce silica particles having a relatively narrow particle size distribution.

A method for producing silica particles by the sol-gel method will be described below.

First, an alkoxysilane is hydrolyzed and condensed with a catalyst in an organic solvent in the presence of water to produce a silica sol suspension. The solvent is removed from the silica sol suspension. Drying the resulting product yields silica particles. The silica particles are hydrophilic because of many silanol groups and therefore often have a mass loss rate of more than 2%. In order to reduce the mass loss rate of the silica particles produced by the sol-gel method to 0.60% or less, the silica particles are heated at a temperature in the range of 300° C. to 500° C. The heating can dehydrate and condense the silanol groups of the silica particles to reduce the number of silanol groups and the mass loss rate of the silica particles.

In the case that the silica particles are subjected to hydrophobic treatment with a hydrophobic treatment agent, heat treatment at a temperature in the range of 300° C. to 500° C. may be performed before, after, or simultaneously with the hydrophobic treatment. In some hydrophobic treatment agents, heat-treatment simultaneously with or after the hydrophobic treatment may cause thermal decomposition of the hydrophobic treatment agent, and the immobilization rate of the hydrophobic treatment agent may be less than 90%. In such a case, heat treatment may be performed before the hydrophobic treatment.

In order to narrow the particle size distribution of the silica particles-A and enhance the spacer effect, silica particles may be crushed. The crushing may be performed before, after, or simultaneously with the hydrophobic treatment. Crushing before the hydrophobic treatment allows the surface of each silica particle to be uniformly treated with the hydrophobic treatment agent.

The amount (the amount of internal addition) of silica particles-A in toner particles is preferably 0.01 parts by mass or more and 10.00 parts by mass or less, more preferably 0.20 parts by mass or more and 5.00 parts by mass or less, per 100 parts by mass of toner particles. The amount of silica particles-A in toner particles within the range described above results in satisfactory effects of the silica particles.

A toner according to an embodiment of the present invention will be further described below.

A toner according to an embodiment of the present invention preferably has a weight-average particle diameter (D4) of 4.0 μm or more and 9.0 μm or less, more preferably 5.0 μm or more and 7.5 μm or less. When the toner has a weight-average particle diameter (D4) within the range described above, this results in the prevention of charge-up, fogging, toner scattering, and low optical density.

Toner particles contained in a toner according to an embodiment of the present invention may contain at least one wax. The total wax content of the toner particles is preferably 2.5 parts by mass or more and 25.0 parts by mass, more preferably 4.0 parts by mass or more and 20 parts by mass or less, still more preferably 6.0 parts by mass or more and 18.0 parts by mass or less, per 100 parts by mass of the toner particles. When the wax content is within the range described above, the wax can bleed moderately while the toner is hot-pressed in fixing, thereby preventing a transfer material from winding around a fixing member. Furthermore, the wax does not excessively bleed on the surface of each toner particle even under stress applied to the toner during development or transfer, resulting in more uniform triboelectric charging of each toner particle.

Examples of the wax include aliphatic hydrocarbon waxes, such as low-molecular-weight polyethylene, low-molecular-weight polypropylene, microcrystalline waxes, Fischer-Tropsch waxes, and paraffin waxes, oxides of aliphatic hydrocarbon waxes, such as oxidized polyethylene wax, and block copolymers thereof, waxes mainly composed of fatty acid esters, such as carnauba wax and montanic acid ester waxes, and partly or entirely deoxidized fatty acid esters, such as deoxidized carnauba wax, saturated straight-chain fatty acids, such as palmitic acid, stearic acid, and montanic acid, unsaturated fatty acids, such as brassidic acid, eleostearic acid and parinaric acid, saturated alcohols, such as stearyl alcohol, aralkyl alcohols, behenyl alcohol, carnaubyl alcohol, ceryl alcohol, and myricyl alcohol, polyhydric alcohols, such as sorbitol, fatty acid amides, such as linoleamide, oleamide, and lauramide, saturated fatty acid bisamides, such as methylenebisstearamide, ethylenebiscapramide, ethylenebislauramide, and hexamethylenebisstearamide, unsaturated fatty acid amides, such as ethylenebisoleamide, hexamethylenebisoleamide, N,N'-dioleyladipamide, and N,N'-dioleylsebacamide, aromatic bisamides, such as m-xylenebisstearamide and N,N'-distearylisophthalamide, aliphatic metal salts (generally referred to as metallic soap), such as calcium stearate, calcium laurate, zinc stearate, and magnesium stearate, aliphatic hydrocarbon waxes grafted with a vinyl monomer, such as styrene or acrylic acid, partial esters between a fatty acid, such as behenic acid monoglyceride, and a polyhydric alcohol, and methyl ester compounds having a hydroxy group produced by hydrogenation of vegetable oils and fats.

Examples of the binder resin for toner particles include homopolymers of styrene and its substitution products, such as polystyrene, poly-p-chlorostyrene, and polyvinyltoluene, and styrene copolymers, such as styrene-p-chlorostyrene copolymers, styrene-vinyltoluene copolymers, styrene-vinylnaphthalene copolymers, styrene-acrylate copolymers, styrene-methacrylate copolymers, styrene-α-chloromethyl methacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers.

Examples of other toner binder resins include poly(vinyl chloride), phenolic resins, natural modified phenolic resins, natural-resin-modified maleic acid resins, acrylic resins, methacrylate resins, poly(vinyl acetate), silicone resins, polyester resins, polyurethane resins, polyamide resins, furan resins, epoxy resins, xylene resins, poly(vinyl butyral), terpene resins, coumarone-indene resins, and petroleum resins. These resins may be used alone or in combination.

Toner particles for use in an embodiment of the present invention can be produced by the process (i) or (ii). The process (i) is also referred to as a suspension polymerization method, and the process (ii) is also referred to as a dissolution suspension method.

The silica particles-A may be contained in toner base particles by adding a powder of silica particles or silica particles dispersed in a liquid in a suspension polymerization method or a dissolution suspension method. The silica particles may be added before particles of a toner composition (a polymerizable monomer composition or a resin solution) is formed in an aqueous medium. The silica particles may be added simultaneously with the addition of other substances to a polymerizable monomer or an organic solvent, before the addition of a toner composition to an aqueous medium, or during the formation of toner composition particles.

A suspension polymerization method will be described below as a method for producing a toner according to an embodiment of the present invention.

A polymerizable monomer composition that contains a polymerizable monomer, silica particles-A, a colorant, a wax, and optional additive agents is dissolved or dispersed in a dispersing apparatus. The polymerizable monomer composition is then suspended in an aqueous medium containing a dispersion stabilizer. Thus, particles of the polymerizable monomer composition are formed in the aqueous medium. The polymerizable monomer in the particles of the polymerizable monomer composition is polymerized in the presence of a polymerization initiator to produce toner particles. The polymerization initiator may be added to the polymerizable monomer composition in advance or may be added to the aqueous medium immediately before the addition of the polymerizable monomer composition. After the formation of the particles of the polymerizable monomer composition and before the initiation of the polymerization reaction of the polymerizable monomer, the polymerization initiator dissolved in the polymerizable monomer or a solvent may be added. The dispersing apparatus may be a homogenizer, a ball mill, a colloid mill, or an ultrasonic homogenizer.

The polymerizable monomer may be a radical polymerizable vinyl monomer. The polymerizable vinyl monomer may be a monofunctional polymerizable monomer or a polyfunctional polymerizable monomer.

Examples of the monofunctional polymerizable monomer include styrene, styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene, polymerizable acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate, polymerizable methacryl monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate, methylene aliphatic monocarboxylates, vinyl esters, such as vinyl acetate, vinyl propionate, vinyl butyrate, vinyl benzoate, and vinyl formate, vinyl ethers, such as vinyl methyl ether, vinyl ethyl ether, and vinyl isobutyl ether, and vinyl ketones, such as vinyl methyl ketone, vinyl hexyl ketone, and vinyl isopropyl ketone.

Examples of the polyfunctional polymerizable monomer include diethylene glycol diacrylate, triethylene glycol diacrylate, tetraethylene glycol diacrylate, poly(ethylene glycol) diacrylate, 1,6-hexanediol diacrylate, neopentyl glycol diacrylate, tripropylene glycol diacrylate, poly(propylene glycol) diacrylate, 2,2'-bis(4-(acryloxy diethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, poly(ethylene glycol) dimethacrylate, 1,3-butylene glycol dimethacrylate, 1,6-hexanediol dimethacrylate, neopentyl glycol dimethacrylate, poly(propylene glycol) dimethacrylate, 2,2'-bis(4-(methacryloxy diethoxy)phenyl)propane, 2,2'-bis(4-(methacryloxy polyethoxy)phenyl)propane, trimethylolpropane trimethacrylate, tetramethylolmethane tetramethacrylate, divinylbenzene, divinylnaphthalene, and divinyl ether.

These monofunctional polymerizable monomers may be used alone or in combination or may be used in combination with a polyfunctional polymerizable monomer. The polyfunctional polymerizable monomer may also be used as a crosslinking agent.

The polymerization initiator for use in the polymerization of the polymerizable monomer may be an oil-soluble initiator or a water-soluble initiator.

Examples of the oil-soluble initiator include azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile, and peroxide initiators, such as acetylcyclohexylsulfonyl peroxide, diisopropyl peroxycarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methyl ethyl ketone peroxide, dicumyl peroxide, t-butyl hydroperoxide, di-t-butyl peroxide, and cumene hydroperoxide.

Examples of the water-soluble initiators include ammonium persulfate, potassium persulfate, 2,2'-azobis(N,N'-dimethylene isobutyramidine) hydrochloride, 2,2'-azobis(2-amidinopropane) hydrochloride, azobis(isobutyramidine) hydrochloride, sodium 2,2'-azobisisobutyronitrile sulfonate, iron(II) sulfate, and hydrogen peroxide. A chain transfer agent or a polymerization inhibitor may be used to control the degree of polymerization of the polymerizable monomer.

The crosslinking agent may be a compound having at least two polymerizable double bonds. Examples of such a compound include aromatic divinyl compounds, such as divinylbenzene and divinylnaphthalene, carboxylate esters having two double bonds, such as ethylene glycol diacrylate, ethylene glycol dimethacrylate, and 1,3-butanediol dimethacrylate, divinyl compounds, such as divinyl aniline, divinyl ether, divinyl sulfide, and divinyl sulfone, and compounds having at least three vinyl groups. These crosslinking agents may be used alone or in combination.

Examples of the colorant include black, yellow, magenta, and cyan colorants.

Examples of the black colorants include carbon black and magnetic substances. The following colorants may be mixed to control the tint or the electrical resistance of toner particles.

Examples of a pigment yellow colorant include condensed azo compounds, isoindolinone compounds, anthraquinone compounds, azo metal complex methine compounds, and allylamide compounds. Specific examples include C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193, and 199.

Examples of a dye yellow colorant include C.I. solvent Yellow 33, 56, 79, 82, 93, 112, 162, and 163 and C.I. disperse Yellow 42, 64, 201, and 211.

Examples of the magenta colorant include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C.I. Pigment Violet 19.

Examples of the cyan colorant include phthalocyanine compounds, phthalocyanine compound derivatives, anthraquinone compounds, and basic dye lake compounds. Specific examples include C.I. Pigment blue 1, 7, 15, 15:1, 15:2, 15:3, 15:4, 60, 62, and 66.

These colorants may be used alone or in combination. At least two colorants may be used as a mixture or as a solid solution.

The colorant may be selected in terms of hue angle, color saturation, lightness value, weatherability, OHP transparency, and dispersibility in toner particles.

The colorant content of the toner particles may be 1 part by mass or more and 20 parts by mass or less per 100 parts by mass of binder resin of the toner particles.

The toner may contain a charge control agent to maintain stable toner chargeability.

Examples of a negative charge control agent include monoazo metallic compounds, acetylacetone metallic compounds, aromatic oxycarboxylic acids, aromatic dicarboxylic acids, oxycarboxylic acids, dicarboxylic acids, and metallic compounds, anhydrides, and ester compounds thereof, phenol derivatives, such as bisphenol, urea derivatives, metal-containing salicylic acid compounds, metal-containing naphthoic acid compounds, boron compounds, quaternary ammonium salts, calixarenes, and resin charge control agents.

Examples of a positive charge control agent include nigrosine and fatty acid metal salt-modified nigrosine materials, guanidine compounds, imidazole compounds, quaternary ammonium salts, such as tributylbenzylammonium-1-hydroxy-4-naphthosulfonate and tetrabutylammonium tetrafluoroborate, and their analogs including onium salts, such as phosphonium salts, and lake pigments thereof, triphenylmethane dyes and lake pigments thereof (examples of the laking agent include phosphotungstic acid, phosphomolybdic acid, phosphotungstenmolybdic acid, tannic acid, lauric acid, gallic acid, ferricyanide, and ferrocyanide), higher fatty acid metal salt, diorganotin oxides, such as dibutyltin oxide, dioctyltin oxide, and dicyclohexyltin oxide; and diorganotin borates, such as dibutyltin borate, dioctyltin borate, and dicyclohexyltin borate, and resin charge control agents.

These negative and positive charge control agents may be used alone or in combination.

Among these, the charge control agent may be a metal salicylic acid compound. The metal of the salicylic acid compound may be aluminum or zirconium. One example is an aluminum salicylate compound.

The charge control agent content of the toner particles is preferably 0.01 parts by mass or more and 20.00 parts by mass or less, more preferably 0.50 parts by mass or more and 10.00 parts by mass or less, per 100 parts by mass of binder resin of the toner particles.

In a toner according to an embodiment of the present invention, inorganic fine particles (an inorganic fine powder) may be externally added to the toner base particles to improve charging stability, developability, flowability, and transferability. Examples of the inorganic fine particles as an external additive include fine particles of a metal oxide, such as silica, alumina, or titania, or a complex oxide thereof, and fluorocarbon fine particles. These external additive may be used alone or in combination. In particular, fine particles of silica, alumina, titania, or a complex oxide thereof can improve flowability and chargeability of the toner and have high adsorptivity to the toner base particles. The external additive inorganic fine particles may have an average primary particle size of 5 nm or more and 70 nm or less in terms of the flowability and chargeability of the toner. Among silica particles for use in toners, the silica (fine) particles externally added to toner base particles are also referred to as "silica particles-B".

The external additive inorganic fine particles may be subjected to hydrophobic treatment. The hydrophobic treatment method and the hydrophobic treatment agent may be the same as in the hydrophobic treatment of the silica particles-A.

The total amount of inorganic fine particles externally added to the toner base particles is preferably 0.5 parts by mass or more and 4.5 parts by mass or less, more preferably 0.8 parts by mass or more and 3.5 parts by mass or less, per 100 parts by mass of the toner base particles. When the total amount of external additive inorganic fine particles is within the range described above, the toner has satisfactory flowability, and fogging or toner scattering due to low toner chargeability can be prevented.

The external additive other than the inorganic fine particles may be charge control particles, an abrasive, or a lubricant.

Examples of the charge control particles include particles of a metal oxide, such as tin oxide, titania, zinc oxide, alumina, or antimony oxide, and carbon black.

Examples of the abrasive include metal oxides, such as strontium titanate, cerium oxide, aluminum oxide, magnesium oxide, and chromium oxide. Examples of the abrasive include nitrides, such as silicon nitride, carbides, such as silicon carbide, and metal salts, such as calcium sulfate, barium sulfate, and calcium carbonate.

The toner may contain a lubricant in order to prevent the soiling of various members in an electrophotographic apparatus.

Examples of the lubricant include fluoropolymers, such as poly(vinylidene fluoride) and polytetrafluoroethylene, and fatty acid metal salts, such as zinc stearate and calcium stearate. The lubricant may be zinc stearate.

The amount of each of charge control particles, abrasive, and lubricant (excluding the inorganic fine particles) is preferably 0.01 parts by mass or more and 2.50 parts by mass or less, more preferably 0.10 parts by mass or more and 2.00 parts by mass or less, per 100 parts by mass of the toner base particles.

A toner according to an embodiment of the present invention may be used in a high-speed system, an oilless fixing system, or a cleaner-less system. A toner according to an embodiment of the present invention may be used in a developing system that continuously collects a carrier in a developing apparatus that has deteriorated because of long-term use and supplies a fresh carrier to the developing apparatus. A toner according to an embodiment of the present invention may be used in a one-component developing system or a two-component developing system. In particular, because of its excellent transferability, a toner according to an embodiment of the present invention may be suitably used in an electrophotographic apparatus (an image forming method) including an intermediate transfer member or an electrophotographic apparatus (an image forming method) employing a cleaner-less system, whether or not the electrophotographic apparatus is a one-component developing system or a two-component developing system.

<Method for Measuring Weight-Average Particle Diameter (D4)>

The weight-average particle diameter (D4) of toner was calculated as described below.

The measuring apparatus was a precision particle size distribution analyzer having a 100 μm aperture tube manufactured by Beckman Coulter, Inc. (trade name: Coulter Counter Multisizer 3) utilizing an aperture impedance method. The measurement condition setting and the analysis of measured data were performed with dedicated software attached to the precision particle size distribution analyzer available from Beckman Coulter, Inc. (trade name: Beckman Coulter Multisizer 3 Version 3.51). Measurement was performed at an effective measuring channel number of 25000. The aqueous electrolyte used in the measurement was 1% by mass special grade sodium chloride dissolved in ion-exchanged water. Such an aqueous electrolyte may be "Isoton II" (manufactured by Beckman Coulter, Inc.).

Before the measurement and analysis, the dedicated software was set up as described below.

On the "Standard operation mode (SOM) setting" screen of the dedicated software, the total count number in control mode was set at 50,000 particles, the number of measurements was set at 1, and the Kd value was obtained using standard particles 10.0 μm available from Beckman Coulter, Inc. A "Threshold/noise level measurement button" was pushed to automatically set the threshold and noise level. The current was set at 1600 μA. The gain was set at 2. Isoton II was selected as an electrolyte solution. "Flushing of aperture tube after measurement" was checked. On the "Conversion of pulse into particle size" screen of the dedicated software, the bin interval was set at logarithmic particle size, the particle size bin was set at 256 particle size bin, and the particle size range was set at 2 to 60 μm.

The following is a specific measurement method.

(1) A 250-mL round bottom glass beaker for Multisizer 3 was charged with 200 mL of the aqueous electrolyte and was placed on a sample stand. A stirrer rod was rotated counterclockwise at 24 rotations/second. Soiling and air bubbles in the aperture tube were removed using the function of "Aperture flushing" of the dedicated software.

(2) A 100-mL flat bottom glass beaker was charged with 30 mL of the aqueous electrolyte. To the aqueous electrolyte was added 0.3 mL of a dispersant "Contaminon N" (a 10% by mass aqueous neutral detergent for cleaning a precise measuring instrument composed of a nonionic surfactant, an anionic surfactant, and an organic builder, pH 7, manufactured by Wako Pure Chemical Industries, Ltd.) diluted 3-fold by mass with ion-exchanged water.

(3) An ultrasonic disperser manufactured by Nikkaki-Bios Co., Ltd. (trade name: Ultrasonic Dispersion System Tetora 150) was prepared. The ultrasonic disperser includes two oscillators having an oscillation frequency of 50 kHz and has an electrical output of 120 W. The two oscillators have a phase difference of 180 degrees. A water tank of the ultrasonic disperser was charged with 3.3 L of ion-exchanged water. 2 mL of Contaminon N was added to the ion-exchanged water.

(4) The beaker prepared in (2) was placed in a beaker-holding hole in the ultrasonic disperser, and the ultrasonic disperser was actuated. The vertical position of the beaker was altered such that the resonance of the surface of the aqueous electrolyte in the beaker was highest.

(5) While the aqueous electrolyte in the beaker prepared in (4) was irradiated with ultrasonic waves, 10 mg of toner was added little by little to the aqueous electrolyte and was dispersed. The ultrasonic dispersion treatment was continued for another 60 seconds. During the ultrasonic dispersion, the water temperature of the water tank was controlled at 10° C. or more and 40° C. or less.

(6) The aqueous electrolyte containing the dispersed toner prepared in (5) was added dropwise with a pipette into the round bottom beaker prepared in (1) placed on the sample stand such that the measurement concentration was 5%. Measurement was continued until the number of measured particles reached 50,000.

(7) The measured data were analyzed with the dedicated software to determine the weight-average particle diameter (D4). The weight-average particle diameter (D4) is the "Average diameter" on the "Analysis/volume statistics (arithmetic mean)" screen in the setting of graph/% by volume in the dedicated software.

<Method for Measuring Average Particle Size of Primary Particle of Inorganic Fine Particles>

The average particle size of the primary particles of inorganic fine particles was determined by observing the inorganic fine particles with a transmission electron microscope and calculating the average major axis length of 300 primary particles having a major axis length of 1 nm or more in a visual field at a magnification in the range of 30,000 to 50,000. When the sampled particles were too small to measure the particle size even at a magnification of 50,000, a photograph was further enlarged such that the primary particle size was 5 mm or more.

<Production Example of Silica Particles 1>

589.6 g of methanol, 42.0 g of water, and 47.1 g of 28% by mass aqueous ammonia were mixed in a 3-L glass reactor equipped with a stirrer, a dropping funnel, and a thermometer. The temperature of the resulting solution was altered to 35° C. 1100.0 g (7.23 mol) of tetramethoxysilane and 395.2 g of 5.4% by mass aqueous ammonia were simultaneously added to the solution while stirring. The tetramethoxysilane was added dropwise for 6 hours, and the aqueous ammonia was added dropwise for 5 hours. After the completion of the addition, the solution was stirred for another 0.5 hours for hydrolysis, thus yielding a dispersion of hydrophilic spherical sol-gel silica fine particles in methanol-water. The glass reactor was provided with an ester adapter and a condenser tube, and the dispersion was sufficiently dried at 80° C. under reduced pressure. The resulting silica particles were heated in a thermostat at 400° C. for 10 minutes.

The process was performed more than once. The resulting silica particles were crushed in a pulverizer (manufactured by Hosokawa Micron Corp.).

In the subsequent surface treatment process, first, 500 g of silica particles were charged in a polytetrafluoroethylene inner tube type stainless steel autoclave having an internal volume of 1000 mL. The autoclave was then purged with nitrogen gas. While the impeller blades of the autoclave were rotated at 400 rpm, 3.5 g of hexamethyldisilazane (HMDS, a surface-treating agent) and 1.0 g of water were then uniformly sprayed over the silica particles using a two-fluid nozzle. After stirring for 30 minutes, the autoclave was tightly closed and was heated at 200° C. for two hours. The system was subjected to deammoniation treatment under reduced pressure while heating to produce silica particles 1. Table 1 shows the physical properties of the silica particles 1.

<Production Examples of Silica Particles 2 to 5>

The initial amount of methanol in the production example of the silica particles 1 was changed from 589.6 g to 707.5, 453.0, 380.4, and 224.0 g to control the volume-average particle diameter (Dv) and the coefficient of variation of volume particle size distribution of silica particles. Furthermore, the amounts of HMDS and water were controlled in the surface treatment with HMDS such that the carbon content was the same as the silica particles 1. Thus, silica particles 2 to 5 were produced. Table 1 shows the physical properties of the silica particles 2 to 5.

<Production Examples of Silica Particles 6 to 8>

The drop time of tetramethoxysilane in the production example of the silica particles 1 was changed from 6 hours to 5, 3, and 3 hours, and the drop time of 5.4% by mass aqueous ammonia was changed from 5 hours to 4, 3, and 2.5 hours to control the volume-average particle diameter (Dv) and the coefficient of variation of volume particle size distribution of silica particles. Furthermore, the amounts of HMDS and water were controlled in the surface treatment with HMDS such that the carbon content was the same as the silica particles 1. Thus, silica particles 6 to 8 were produced. Table 1 shows the physical properties of the silica particles 6 to 8.

<Production Examples of Silica Particles 9 and 10>

The heating time in the thermostat at 400° C. in the production example of the silica particles 1 was changed from 10 minutes to 8 and 3.2 minutes to control the mass loss rate. Furthermore, the amounts of HMDS and water were controlled in the surface treatment with HMDS such that the carbon content was the same as the silica particles 1. Thus, silica particles 9 and 10 were produced. Table 1 shows the physical properties of the silica particles 9 and 10.

<Production Example of Silica Particles 11>

The heating temperature in the surface treatment with HMDS in the production example of the silica particles 10 was altered such that the immobilization rate was 88% to produce silica particles 11. Table 1 shows the physical properties of the silica particles 11.

<Production Example of Silica Particles 12>

The amounts of HMDS and water in the production example of the silica particles 1 were changed from 3.5 g and 1.0 g to 2.5 g and 1.0 g, respectively, to produce silica particles 12. Table 1 shows the physical properties of the silica particles 12.

<Production Example of Silica Particles 13>

3.5 g of HMDS and 1.0 g of water in the surface treatment process in the production example of the silica particles 1 were substituted by 4.0 g of polydimethylsiloxane (PDMS) (trade name: KF96-10cs, manufactured by Shin-Etsu Chemical Co., Ltd.) diluted with 9.0 g of hexane. After stirring at 200° C. for two hours, silica particles 13 were obtained. Table 1 shows the physical properties of the silica particles 13.

<Production Example of Silica Particles 14>

The amounts of PDMS and hexane in the production example of the silica particles 13 were changed from 4.0 g and 9.0 g to 7.0 g and 16.0 g, respectively, to produce silica particles 14. Table 1 shows the physical properties of the silica particles 14.

<Production Example of Silica Particles 15>

Silica particles (fumed silica) having a volume-average particle diameter (Dv) of 92 nm were produced by a firing method and were air-classified to produce silica particles having a volume-average particle diameter (Dv) of 85 nm and a coefficient of variation of volume particle size distribution of 21%. In the same manner as in the case of the silica particles 1, the silica particles were surface-treated with HMDS to yield silica particles 15. Table 1 shows the physical properties of the silica particles 15.

<Production Example of Silica Particles 16>

In accordance with a method described in Japanese Patent Laid-Open No. 60-255602, silica particles having a volume-average particle diameter (Dv) of 150 nm were produced by a deflagration method using metallic silicon as a raw material. The coefficient of variation of volume particle size distribution was 30%. The silica particles were air-classified to produce silica particles having a volume-average particle diameter (Dv) of 120 nm and a coefficient of variation of volume particle size distribution of 21%. In the same manner as in the case of the silica particles 1, the silica particles were surface-treated with HMDS to yield silica particles 16. Table 1 shows the physical properties of the silica particles 16.

<Production Example of Silica Particles 17>

Silica particles (fumed silica) having a volume-average particle diameter (Dv) of 50 nm were produced by a firing method and were air-classified to produce silica particles having a volume-average particle diameter (Dv) of 40 nm and a coefficient of variation of volume particle size distribution of 18%. In the same manner as in the case of the silica particles 1, the silica particles were surface-treated with HMDS to yield silica particles 17. Table 1 shows the physical properties of the silica particles 17.

<Production Example of Silica Particles 18>

The atmosphere of a reaction vessel was substituted by a gas mixture of argon and oxygen mixed at a volume ratio of 3:1. The reaction vessel was supplied with oxygen gas at 40 ($m^3$/h) and hydrogen gas at 20 ($m^3$/h). An oxygen-hydrogen combustion flame was formed with an ignition device. A raw material metallic silicon powder was then introduced into the combustion flame using a hydrogen carrier gas having a pressure of 12 kg/$cm^2$, thereby forming a dust cloud. The dust concentration was 20 g/$m^3$. The dust cloud was ignited with a combustion flame to cause an oxidation reaction by dust explosion. The interior of the reaction vessel was cooled at 3° C./min to produce silica particles. The silica particles were air-classified to remove a fine powder and a coarse powder. In the same manner as in the case of the silica particles 1, the silica particles were surface-treated with HMDS to yield silica particles 18. Table 1 shows the physical properties of the silica particles 18.

<Production Example of Silica Particles 19>

The heating time in the thermostat at 400° C. in the production example of the silica particles 1 was changed from 10 minutes to 1.4 minutes to control the mass loss rate. Furthermore, the amounts of HMDS and water were controlled in the surface treatment with HMDS such that the carbon content was the same as the silica particles 1. Thus, silica particles 19 were produced. Table 1 shows the physical properties of the silica particles 19.

<Production Example of Silica Particles 20>

Silica particles 20 were produced in the same manner as in the production example of the silica particles 1 except that the surface treatment with HMDS was not performed. Table 1 shows the physical properties of the silica particles 20.

<Production Example of Silica Particles 21>

The amounts of HMDS and water in the production example of the silica particles 1 were changed from 3.5 g and 1.0 g to 10.0 g and 1.5 g, respectively, to produce silica particles 21. Table 1 shows the physical properties of the silica particles 21.

TABLE 1

| Silica particles | Production method | Surface-treating agent | Volume-average particle diameter (Dv) (nm) | Coefficient of variation of volume particle size distribution (%) | Mass loss rate (%) | Hydrophobicity (%) | Carbon content (mass %) | Immobilization rate of hydrophobic treatment agent (%) |
|---|---|---|---|---|---|---|---|---|
| Silica particles 1 | Sol-gel method | HMDS | 100 | 9 | 0.01 | 21 | 0.7 | 95 |
| Silica particles 2 | Sol-gel method | HMDS | 50 | 10 | 0.01 | 18 | 0.7 | 95 |
| Silica particles 3 | Sol-gel method | HMDS | 200 | 10 | 0.01 | 23 | 0.7 | 94 |
| Silica particles 4 | Sol-gel method | HMDS | 400 | 9 | 0.01 | 27 | 0.7 | 94 |
| Silica particles 5 | Sol-gel method | HMDS | 780 | 13 | 0.01 | 34 | 0.7 | 94 |
| Silica particles 6 | Sol-gel method | HMDS | 190 | 15 | 0.02 | 23 | 0.7 | 95 |
| Silica particles 7 | Sol-gel method | HMDS | 200 | 23 | 0.02 | 21 | 0.7 | 95 |
| Silica particles 8 | Sol-gel method | HMDS | 220 | 26 | 0.01 | 21 | 0.7 | 94 |
| Silica particles 9 | Sol-gel method | HMDS | 100 | 9 | 0.10 | 23 | 0.7 | 93 |
| Silica particles 10 | Sol-gel method | HMDS | 100 | 9 | 0.60 | 25 | 0.7 | 93 |

TABLE 1-continued

| Silica particles | Production method | Surface-treating agent | Volume-average particle diameter (Dv) (nm) | Coefficient of variation of volume particle size distribution (%) | Mass loss rate (%) | Hydrophobicity (%) | Carbon content (mass %) | Immobilization rate of hydrophobic treatment agent (%) |
|---|---|---|---|---|---|---|---|---|
| Silica particles 11 | Sol-gel method | HMDS | 100 | 9 | 0.60 | 25 | 0.7 | 88 |
| Silica particles 12 | Sol-gel method | HMDS | 100 | 9 | 0.01 | 6 | 0.5 | 96 |
| Silica particles 13 | Sol-gel method | PDMS | 100 | 9 | 0.01 | 30 | 0.8 | 94 |
| Silica particles 14 | Sol-gel method | PDMS | 100 | 9 | 0.01 | 36 | 1.3 | 92 |
| Silica particles 15 | Fumed method | HMDS | 85 | 21 | 0.14 | 32 | 0.7 | 93 |
| Silica particles 16 | Deflagration method | HMDS | 120 | 21 | 0.06 | 34 | 0.7 | 92 |
| Silica particles 17 | Fumed method | HMDS | 40 | 18 | 0.01 | 23 | 0.7 | 91 |
| Silica particles 18 | Deflagration method | HMDS | 1200 | 32 | 0.01 | 18 | 0.7 | 91 |
| Silica particles 19 | Sol-gel method | HMDS | 100 | 9 | 0.90 | 21 | 0.7 | 95 |
| Silica particles 20 | Sol-gel method | HMDS | 100 | 18 | 0.01 | 0 | 0.0 | 94 |
| Silica particles 21 | Sol-gel method | HMDS | 100 | 22 | 0.01 | 42 | 2.0 | 92 |

<Production Example of Charge Control Resin 1>

A reaction vessel was charged with solvents: 250 parts by mass of methanol, 150 parts by mass of 2-butanone, and 100 parts by mass of 2-propanol. The reaction vessel was charged with monomers: 77 parts by mass of styrene, 15 parts by mass of 2-ethylhexyl acrylate, and 8 parts by mass of 2-acrylamide-2-methylpropanesulfonic acid. The reaction vessel could be pressurized and was equipped with a reflux tube, a stirrer, a thermometer, a nitrogen inlet, a dropping apparatus, and a decompressor. After the reaction vessel was charged with materials, the reaction vessel was heated to a reflux temperature while stirring. One part by mass of a polymerization initiator t-butylperoxy-2-ethylhexanoate was diluted with 20 parts by mass of 2-butanone. The solution of t-butylperoxy-2-ethylhexanoate was added dropwise for 30 minutes. Agitation was continued for 5 hours. Another 1 part by mass of t-butylperoxy-2-ethylhexanoate was diluted with 20 parts by mass of 2-butanone. The solution of t-butylperoxy-2-ethylhexanoate was added dropwise for 30 minutes. Agitation was continued for 5 hours to complete the polymerization reaction. 500 parts by mass of deionized water was added while maintaining the temperature. Agitation was continued for two hours at 80 to 100 rotations/minute so as not to form a turbulent interface between the organic layer and the aqueous layer. After the solution was left still for 30 minutes for phase separation, the aqueous layer was discarded, and the organic layer was dried over anhydrous sodium sulfate. After the polymerization solvent was evaporated under reduced pressure, the resulting polymer was roughly crushed to 100 μm or less with a cutter mill having a 150-mesh screen. The resulting charge control resin 1 containing a sulfur atom had Tg of 58° C., Mp of 13,000, and Mw of 30,000.

<Production Example of Toner 1>

16.5 parts by mass of C.I. Pigment Blue 15:3 and 3.0 parts by mass of an aluminum compound of di-t-butyl salicylic acid (trade name: Bontron E88, manufactured by Orient Chemical Industries Co., Ltd.) per 100 parts by mass of styrene monomer were prepared. These materials were mixed in an attritor (manufactured by Mitsui Mining Co., Ltd.) using 140 parts by mass of zirconia beads having a radius of 1.25 mm at 200 rpm at 25° C. for 180 minutes to produce a masterbatch dispersion 1.

450 parts by mass of 0.1 M aqueous $Na_3PO_4$ in 710 parts by mass of ion-exchanged water was heated to 60° C. 67.7 parts by mass of 1.0 M aqueous $CaCl_2$ was slowly added to the aqueous $Na_3PO_4$ to produce an aqueous medium containing a calcium phosphate compound.

Masterbatch dispersion 1 40 parts by mass

Styrene monomer 28 parts by mass n-Butyl acrylate monomer 18 parts by mass

Low-molecular-weight polystyrene (Mw: 3,000, Mn: 1,050, Tg: 55° C.) 20 parts by mass Hydrocarbon wax (Fischer-Tropsch wax, maximum endothermic peak temperature: 78° C., Mw: 750) 9 parts by mass Charge control resin 1 0.3 parts by mass Polyester resin (polycondensate of terephthalic acid:isophthalic acid:propylene oxide-modified bisphenol A (2-mol adduct):ethylene oxide-modified bisphenol A (2-mol adduct)=30:30:30:10, Mw: 11,000, Mn: 4,000, Tg: 74° C.) 5 parts by mass Silica particles 1 3 parts by mass These materials were heated to 65° C. and were homogeneously dissolved and dispersed in a TK homo mixer (Tokushu Kika Kogyo Co., Ltd.) at 5,000 rpm. 7.1 parts by mass of a 70% polymerization initiator 1,1,3,3-tetramethylbutylperoxy-2-ethylhexanoate in toluene was dissolved in the dispersion to produce a polymerizable monomer composition (toner composition).

The polymerizable monomer composition was added to the aqueous medium and was stirred in a TK homo mixer at a temperature of 65° C. in a $N_2$ atmosphere at 10,000 rpm for 10 minutes to form particles of the polymerizable monomer composition. The aqueous medium was heated to a temperature of 67° C. while stirring with a paddle blade. When the polymerization conversion of the polymerizable monomer reached 90%, 0.1 mol/L aqueous sodium hydroxide was added to the aqueous medium to alter the pH of the aqueous medium to 9. The aqueous medium was heated to 80° C. at a heating rate of 40° C./h and was allowed to react for 4 hours. After the completion of the polymerization reaction, the residual monomer was evaporated under reduced pressure. After the aqueous medium was cooled, the pH of the aqueous medium was altered to 1.4 with hydrochloric acid. The aqueous medium was stirred for one hour to dissolve calcium phosphate salt. The dispersion was filtered and washed in a pressure filter to produce a toner cake. The toner cake was crushed and was dried at a temperature of 40° C. for 48 hours. An ultrafine powder and a coarse powder of the dried product were simultaneously removed with a multi-division classifier manufactured by Nittetsu Mining Co., Ltd. (Elbow-Jet classifier) to produce cyan toner base particles having a weight-average particle diameter (D4) of 6.3 μm.

100 parts by mass of the toner base particles were mixed with 1.5 parts by mass of hydrophobic silica fine particles surface-treated with hexamethyldisilazane (number-average particle size of primary particles: 10 nm, silica particles-B) in a Henschel mixer (manufactured by Mitsui Mining Co., Ltd.) for 300 seconds to produce toner 1.

<Production Examples of Toners 2 to 16>

Toners 2 to 16 were produced in the same manner as in the production example of the toner 1 except that the silica particles 1 were substituted by silica particles 2 to 16.

<Production Example of Toner 17>

Polyester A (polycondensate of terephthalic acid:isophthalic acid:propylene oxide-modified bisphenol A (2-mol adduct):ethylene oxide-modified bisphenol A (2-mol adduct)=20:20:44:50 (mass ratio), Mw=7,000, Mn=3,200, Tg=57° C.) 45 parts by mass Polyester B (polycondensate of terephthalic acid:trimellitic acid:propylene oxide-modified bisphenol A (2-mol adduct):ethylene oxide-modified bisphenol A (2-mol adduct)=24:3:70:2 (mass ratio), Mw=11,000, Mn=4,200, Tg=52° C.) 40 parts by mass Methyl ethyl ketone 80 parts by mass Ethyl acetate 80 parts by mass Hydrocarbon wax (Fischer-Tropsch wax, maximum endothermic peak=78° C., Mw=750) 7 parts by mass C.I. Pigment Blue 15:3 6 parts by mass Charge control resin 1 1.9 parts by mass Silica particles 1 3 parts by mass A mixture of these materials was dispersed in an attritor (manufactured by Mitsui Mining & Smelting Co., Ltd.) for 3 hours to produce a colorant dispersion.

17 parts by mass of sodium phosphate in 220 parts by mass of ion-exchanged water was heated to 60° C. 20 parts by mass of 1.0 M aqueous $CaCl_2$ was slowly added to the aqueous sodium phosphate to produce an aqueous medium containing a calcium phosphate compound.

The colorant dispersion was added to the aqueous medium and was stirred in a TK homo mixer at a temperature of 65° C. in a $N_2$ atmosphere at 12,000 rpm for 15 minutes to form (granulate) particles of the colorant dispersion. The TK homo mixer was replaced by a general propeller mixer. The number of rotation was maintained at 150 rpm. The internal temperature was held at 95° C. for 3 hours to remove the solvent from the dispersion, thereby producing a toner particle dispersion.

The pH of the toner particle dispersion was altered to 1.4 with hydrochloric acid. The toner particle dispersion was stirred for one hour to dissolve calcium phosphate salt. The dispersion was filtered and washed in a pressure filter to produce a toner cake. The toner cake was crushed and was dried at a temperature of 40° C. for 48 hours. An ultrafine powder and a coarse powder of the dried product were simultaneously removed with a multi-division classifier manufactured by Nittetsu Mining Co., Ltd. (Elbow-Jet classifier) to produce cyan toner base particles having a weight-average particle diameter (D4) of 6.4 μm.

100 parts by mass of the toner base particles were mixed with 1.5 parts by mass of hydrophobic silica fine particles surface-treated with hexamethyldisilazane (number-average particle size of primary particles: 10 nm, silica particles-B) in a Henschel mixer (manufactured by Mitsui Mining Co., Ltd.) for 300 seconds to produce toner 17.

<Production Examples of Toners 18 to 22>

Toners 18 to 22 were produced in the same manner as in the production example of the toner 1 except that the silica particles 1 were substituted by silica particles 17 to 21.

EXAMPLE 1

The toner 1 was tested as described below. Table 2 shows the results.

[Image Output Test]

Image evaluation was performed in various environments with a laser-beam printer manufactured by CANON KABUSHIKI KAISHA (trade name: LBP7700C). The laser-beam printer (trade name: LBP7700C) is an electrophotographic apparatus that employs a four-drum tandem system including an intermediate transfer belt. A cyan cartridge filled with 140 g of the toner 1 was mounted in a cyan station of the laser-beam printer, and dummy cartridges were mounted in the other stations. An image output test was performed at 15° C./10% RH (a low temperature and low humidity environment) and 30° C./80% RH (a high temperature and high humidity environment). In each of the environments, after 5,000 images having a printing ratio of 1% were printed out, the following evaluation was performed. Letter-size XEROX 4200 paper sheets (manufactured by Xerox Corp., 75 g/$m^2$) were used as image output paper sheets.

(1) Fogging

Letter-size HP Color Laser Photo paper, Glossy (manufactured by Hewlett-Packard Co., 220 g/$m^2$) was used for evaluation. A full white image was printed out at a processing speed of 90 mm/s. The reflectivity (%) of a non-image area of an output image was measured with a "Reflectometer Model TC-6DS" (trade name) manufactured by Tokyo Denshoku. Co., Ltd. equipped with an amber filter. The reflectivity was subtracted from the reflectivity (%) of an unused sheet (reference paper) measured in the same manner. A smaller reflectivity difference indicates less toner adhesion (that is, fogging) in the non-image area of the output image, indicating the prevention of fogging.

Rank A: A reflectivity difference of less than 0.5%.

Rank B: A reflectivity difference of 0.5% or more and less than 1.5%.

Rank C: A reflectivity difference of 1.5% or more and less than 3.0%.

Rank D: A reflectivity difference of 3.0% or more.

(2) Transfer Efficiency

Toner transfer efficiency from an electrophotographic photosensitive member (hereinafter also referred to simply as a "photosensitive member") to a recording paper was measured. A 10-$cm^2$ solid image was formed on the photosensitive member. The transfer efficiency was calculated using the equation transfer efficiency (%)=(W2/W1)×100, wherein W1 denotes the mass of toner on the photosensitive member, and W2 denotes the mass of toner on the paper after transfer. The recording paper was A4-size CLC sheet (manufactured by CANON KABUSHIKI KAISHA, 80 g/$m^2$).

Rank A: A transfer efficiency of 92% or more.

Rank B: A transfer efficiency of 90% or more and less than 92%.

Rank C: A transfer efficiency of 88% or more and less than 90%.

Rank D: A transfer efficiency of less than 88%.

EXAMPLES 2 to 17

The toners 2 to 17 were evaluated in the same manner as in the toner 1. Table 2 shows the results.

COMPARATIVE EXAMPLES 1 to 5

The toners 18 to 22 were evaluated in the same manner as in the toner 1. Table 2 shows the results.

TABLE 2

| | Toner | Silica particle | Weight-average particle diameter (D4) of toner (μm) | Low temperature and low humidity environment: Fogging (%) | | Low temperature and low humidity environment: Transfer efficiency (%) | | High temperature and high humidity environment: Fogging (%) | | High temperature and high humidity environment: Transfer efficiency (%) | |
|---|---|---|---|---|---|---|---|---|---|---|---|
| Example 1 | Toner 1 | Silica particles 1 | 6.3 | A | 0.3 | A | 96 | A | 0.4 | A | 96 |
| Example 2 | Toner 2 | Silica particles 2 | 6.5 | A | 0.3 | A | 92 | A | 0.4 | A | 92 |
| Example 3 | Toner 3 | Silica particles 3 | 6.2 | A | 0.4 | A | 95 | A | 0.4 | A | 96 |
| Example 4 | Toner 4 | Silica particles 4 | 6.3 | B | 0.7 | B | 90 | B | 0.9 | B | 91 |
| Example 5 | Toner 5 | Silica particles 5 | 6.6 | B | 1.0 | B | 90 | B | 1.4 | B | 91 |
| Example 6 | Toner 6 | Silica particles 6 | 6.5 | A | 0.4 | A | 92 | A | 0.4 | A | 93 |
| Example 7 | Toner 7 | Silica particles 7 | 6.2 | A | 0.4 | B | 91 | A | 0.4 | B | 91 |
| Example 8 | Toner 8 | Silica particles 8 | 6.3 | A | 0.4 | B | 90 | B | 0.7 | B | 90 |
| Example 9 | Toner 9 | Silica particles 9 | 6.2 | B | 0.6 | A | 95 | B | 0.9 | A | 96 |
| Example 10 | Toner 10 | Silica particles 10 | 6.3 | B | 0.7 | A | 94 | B | 1.1 | A | 95 |
| Example 11 | Toner 11 | Silica particles 11 | 6.3 | B | 1.1 | A | 95 | B | 1.4 | A | 95 |
| Example 12 | Toner 12 | Silica particles 12 | 6.4 | A | 0.4 | A | 92 | A | 0.4 | A | 93 |
| Example 13 | Toner 13 | Silica particles 13 | 6.4 | A | 0.4 | A | 93 | A | 0.4 | A | 95 |
| Example 14 | Toner 14 | Silica particles 14 | 6.5 | B | 0.7 | B | 90 | B | 0.9 | B | 91 |
| Example 15 | Toner 15 | Silica particles 15 | 6.4 | B | 0.6 | B | 90 | B | 0.8 | A | 93 |
| Example 16 | Toner 16 | Silica particles 16 | 6.1 | B | 0.5 | B | 91 | B | 0.6 | B | 91 |
| Example 17 | Toner 17 | Silica particles 1 | 6.4 | A | 0.4 | A | 95 | A | 0.4 | A | 95 |
| Comparative example 1 | Toner 18 | Silica particles 17 | 6.6 | A | 0.3 | C | 88 | A | 0.4 | D | 87 |
| Comparative example 2 | Toner 19 | Silica particles 18 | 6.1 | C | 1.6 | C | 89 | D | 3.1 | C | 88 |
| Comparative example 3 | Toner 20 | Silica particles 19 | 6.2 | C | 2.1 | B | 90 | D | 3.6 | C | 89 |
| Comparative example 4 | Toner 21 | Silica particles 20 | 6.5 | A | 0.3 | C | 88 | B | 0.6 | D | 86 |
| Comparative example 5 | Toner 22 | Silica particles 21 | 6.5 | B | 0.9 | D | 87 | B | 1.4 | D | 86 |

Examples 1 to 17 had satisfactory results in all the evaluation items. In contrast, Comparative Examples 1 to 5 were rated D in at least one of the evaluation items. More specifically, high-speed printing in the low temperature and low humidity environment and the high temperature and high humidity environment in the comparative examples was inferior to the examples.

Thus, the present invention can provide a toner that can maintain high transferability even in long-term image output, can maintain high chargeability even in a high temperature and high humidity environment, and rarely causes fogging due to charging failure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-202399 filed Sep. 14, 2012, which is hereby incorporated by reference herein in its entirety.

What is claimed is:

1. A method for producing a toner, comprising the following (i) or (ii):

(i) adding a polymerizable monomer composition containing a polymerizable monomer and silica particles to an aqueous medium to form particles of the polymerizable monomer composition, and polymerizing the polymerizable monomer contained in the particles to produce toner particles; or (ii) mixing a binder resin, the silica particles, and an organic solvent that can dissolve the binder resin to prepare a resin solution containing dispersed silica particles and the binder resin dissolved in the organic solvent, adding the resin solution to an aqueous medium to form particles of the resin solution, and removing the organic solvent from the particles to produce toner particles, wherein the silica particles have a volume-average particle diameter (Dv) of 50 nm or more and 800 nm or less, the mass loss rate due to heating of the silica particles from 105° C. to 200° C. is 0.60% or less, and the hydrophobicity of the silica particles is 5% or more and less than 40%.

2. The method for producing a toner according to claim 1, wherein the coefficient of variation of volume particle size distribution of the silica particles is 23% or less.

3. The method for producing a toner according to claim 1, wherein the silica particles are subjected to hydrophobic treatment with a hydrophobic treatment agent.

4. The method for producing a toner according to claim 3, wherein the hydrophobic treatment agent contains carbon.

5. The method for producing a toner according to claim 4, wherein the carbon content of the silica particles derived from the hydrophobic treatment agent is 1.0% by mass or less.

6. The method for producing a toner according to claim 1, wherein the immobilization rate of the hydrophobic treatment agent in the silica particles is 90% or more.

* * * * *